US007019633B1

(12) United States Patent
Villa et al.

(10) Patent No.: US 7,019,633 B1
(45) Date of Patent: Mar. 28, 2006

(54) AUDIO SIGNAL SOUND DIFFUSION SYSTEM

(75) Inventors: Giorgio Dalla Villa, Gorgonzola (IT); Carlo Gaceioli, Via Padova (IT)

(73) Assignee: ADT Services AG, Schaffhausen (CH)

( * ) Notice: Subject to any disclaimer, the term of this patent is extended or adjusted under 35 U.S.C. 154(b) by 882 days.

(21) Appl. No.: 10/031,763

(22) PCT Filed: Jul. 20, 2000

(86) PCT No.: PCT/EP00/06948

§ 371 (c)(1),
(2), (4) Date: Jan. 18, 2002

(87) PCT Pub. No.: WO01/06475

PCT Pub. Date: Jan. 25, 2001

(30) Foreign Application Priority Data

Jul. 20, 1999 (IT) ..... MI99A1597

(51) Int. Cl.
*G08B 29/00* (2006.01)

(52) U.S. Cl. ..... 340/506; 340/825.25

(58) Field of Classification Search ..... 340/506, 340/511, 635, 657, 825.25, 384.1
See application file for complete search history.

(56) References Cited

U.S. PATENT DOCUMENTS 5,988,314 A * 11/1999 Negishi ..... 181/144
6,015,025 A * 1/2000 McGrath et al. ..... 181/199
6,015,026 A * 1/2000 McGrath ..... 181/295
6,295,363 B1 * 9/2001 Laak et al. ..... 381/94.1
6,423,001 B1 * 7/2002 Abreu ..... 600/405

FOREIGN PATENT DOCUMENTS

| | | | |
|---|---|---|---|
| CH | 682 856 | A | 11/1993 |
| DE | 296 11 600 | U | 9/1996 |
| GB | 2 301 465 | A | 12/1996 |
| GB | 2 307 082 | A | 5/1997 |
| WO | WO 98 08205 | A | 2/1998 |

* cited by examiner

*Primary Examiner*—Daryl C Pope
(74) *Attorney, Agent, or Firm*—Fulbright & Jaworski LLP

(57) ABSTRACT

The present invention relates to an audio signal sound diffusion system for diffusing, e.g., alarm signals, pre-recorded signals and microphone signals over wide areas. According to one of its aspects, the present invention relates to an audio signal sound diffusion system characterised in that it comprises: at least one diffuser (35*a*–38*a*, 35*b*–38*b*); at least one amplifier (31–34) connected to said diffuser (35*a*–38*a*, 35*b*–38*b*); a generation circuit (27) for generating at least one audio signal connected to said amplifier (31–34); a control circuit (10) for controlling said sound diffusion system adapted to detect the malfunctions of said diffusion system and to generate a status alarm (14) of said diffusion system; connection means (17, 40) adapted to connect said control circuit (10) to a management system; said control circuit (10) is adapted to send to said management system at least one status alarm (14) of said sound diffusion system.

13 Claims, 4 Drawing Sheets

AUDIO SIGNAL SOUND DIFFUSION SYSTEM

TECHNICAL FIELD

The present invention relates to an audio signal sound diffusion system such as the diffusion of alarm signals, pre-recorded signals and microphone signals over wide areas.

BACKGROUND ART

For the diffusion of alarm signals and vocal announcements over wide areas, a plurality of diffusers connected to one or more amplifiers are normally used.

Such apparatuses, that signal the existence of a danger, have operating periods limited in time alternated by non-operating periods of long length.

In such long inactivity of the apparatuses, which are normally located outside and so exposed to bad weather, they can be subject to failures.

At the moment of their activation, in case of danger, they can be out of order and so they cannot be able to fulfil their task.

Additionally, in case of audio signal sound diffusion systems for wide areas, such as for example the area of an airport or barracks, where different diffusion apparatuses are necessary, whose operating efficiency must be substantially equal to 100%, the activation and control problems of such apparatuses become relevant.

An object of the present invention is to provide an audio signal sound diffusion system able to overcome the inconveniences mentioned above.

DISCLOSURE OF THE INVENTION

According to the present invention, such object is achieved through an audio signal sound diffusion system characterised in that it comprises: at least one diffuser; at least one amplifier connected to said diffuser; a generation circuit of at least one audio signal connected to said amplifier; a control circuit of said sound diffusion system adapted to detect malfunctions of said diffusion system and to generate a status alarm of said diffusion system; connection means adapted to connect said control circuit to a management system; said control system is adapted to send to said management system at least a status alarm of said sound diffusion system.

Thanks to the present invention it is possible to realise a diffusion system able to keep under control, by a management system, the operation of the different elements that form the diffusion system so that a high efficiency is guaranteed.

BRIEF DESCRIPTION OF THE DRAWINGS

The characteristics and the advantages of the present invention will be evident from the following detailed description of one of its embodiments, described as a non-limiting example in the drawings enclosed, wherein.

DETAILED DESCRIPTION OF THE INVENTION

Figure 1:
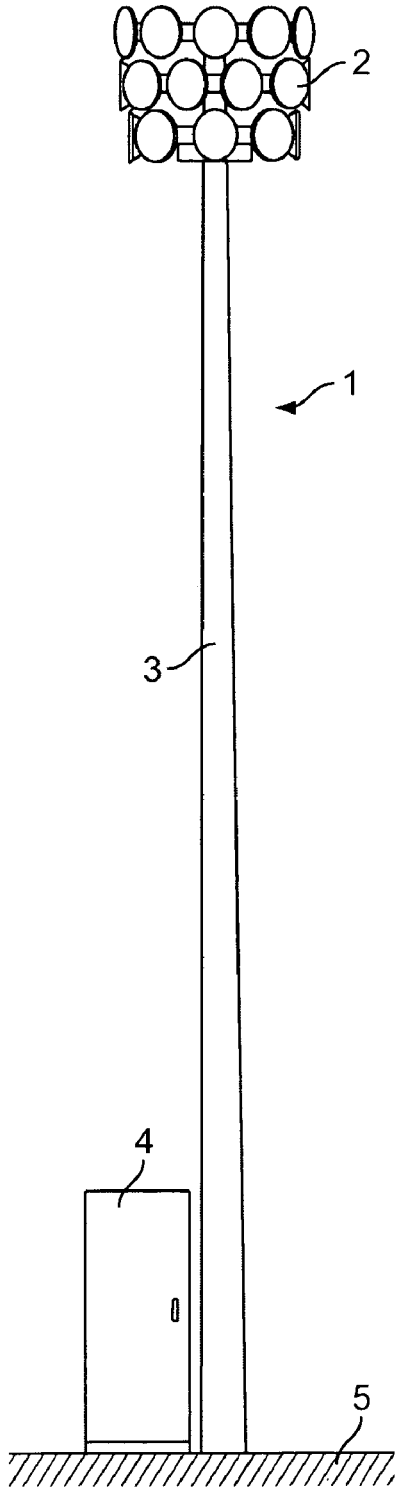
FIG. 1 shows schematically a diffusion point of the diffusion system according to the present invention.

In FIG. 1 number 1 indicates a diffusion point of a diffusion system according to the present invention, that comprises a plurality of diffusers 2 (for example 45W LBC3493/10 horns manufactured by Philips) preferably formed by four groups of seven horns. Such diffusers 2 are located on a pole 3 having a effective length equal to for example 12 meters (for example a Fe510 pole having a base diameter of 355 mm provided by Siderpali), inserted into ground 5. Beside pole 3 a cabinet 4 is located, that contains the control circuit necessary for the operation of diffusion point 1.

Figure 2:
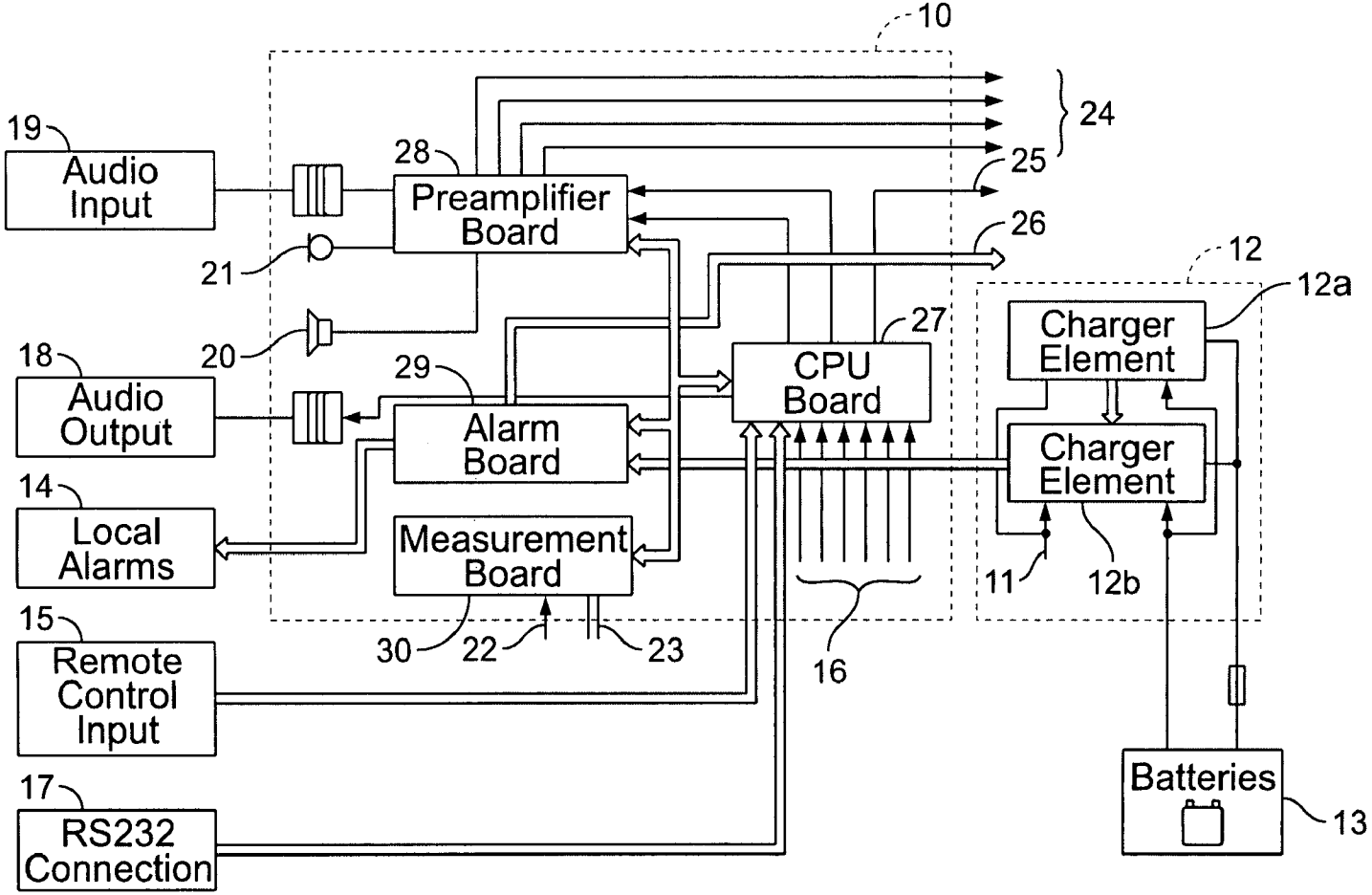
FIG. 2 shows a block diagram of the control circuit of a diffusion point of the diffusion system according to the present invention.

In FIG. 2 a control circuit 10 is shown, that is powered by mains 11 or, as an alternative, when the mains 11 does not work, by an emergency power supply made of batteries 13 and a relevant battery charger 12 made of two elements 12*a* and 12*b* connected in parallel.

Locally, control circuit 10 has a microphone 21 for the diffusion of local vocal announcements, a loudspeaker 20 used as monitor, a series of inputs called local controls 16 that come from a series of switches (put on an external panel not shown in the figure) that allow to activate manually the alarm signal or signals pre-recorded in the control circuit 10, a reset switch to stop the alarm diffusion and a (priority) switch to activate the local controls or remote controls.

Additionally, control circuit 10 comprises an audio input 19 and an audio output 18, a series of remote control inputs 15 having the same functions as local controls 16 and having further an input for the introduction of a remote audio signal.

There is a series of local alarm outputs (or status alarms of diffusion point 1) 14 including the following signalling: local control in progress, priority switch on local, lack of mains, battery low-first level, battery low-second level and amplifier/horns alarm.

Remote control inputs 15 and local alarm outputs 14 are made available to the terminal boxes (not shown in the figures) of the diffusion point 1, for the cable connection (in particular one connection wire for each signal of remote controls 15 and each signal of the local alarms 14) of control circuit 10 to a remote management system. The remote management system is made, in this case, preferably of a computer, but control switches (for remote controls 15) and signal lamps (for local alarms 14) can also be used.

There are also a series of vocal and alarm outputs 24 that are connected at the amplifiers input, a series of on/off outputs 26 for the switching on and off of the amplifiers, an output of the test signal 25 to be applied at the amplifiers input, an output of a control signal 23 of a test relay able to switch the measurement input 22 between each of the amplifiers outputs.

An RS232 connection 17 is also included, locally as well, for the connection to a local management system, in particular a computer for the programming of the parameters relevant to the type or types of alarms to be pre-recorded, for example frequency, duration, rising time, falling time and signal level; and, additionally, to program the initial settings that will be necessary during the operation of the diffusion system to diagnose amplifiers and horns malfunctions.

Control circuit 10 is made of several circuits or boards as it will be described later on.

The system core is Alarm Generator and CPU board 27. Such board 27, through a bus, controls all the other boards and manages the audio signals route towards the final amplifiers. Board 27 receives the controls for the generation of alarms through local or remote inputs and controls, through digital outputs, the lamps of the buttons of the frontal panel, the switching of the inputs of the audio signal and alarm signal of the amplifiers. The alarm generation is realised by board 27. The alarm signal generated in that way is provided on two separate outputs so that it is possible to independently regulate the local signal towards the amplifiers "call" inputs and the remote signal towards the remote audio output. Board 27 also provides a 20 kHz test signal towards the amplifiers for the control function of the amplifier and horn status.

A preamplifier board 28 receives the remote audio signal and the local microphone signal, provides for their regulation and so for the sending of the signal selected at the "music" inputs of the final amplifiers. This board provides also for the amplification of the signal towards the local monitor loudspeaker.

An alarm board 29 receives from the power supply rack, through the battery status control circuits, the status signals relevant to the mains 11 and the charge level of batteries 13: "partially discharged" or "discharged", and it makes it available with the local alarms. Through these signals the board is able to manage the power amplifiers and, in case mains is lacking, realise a load reduction through On/Off commands towards the amplifiers. In case mains 11 voltage is lacking, control circuit 10 provides four On/Off commands 26 connected to amplifiers 31–34; on a first level of battery discharge two amplifiers are switched off, on a second discharge level the last two amplifiers are switched off, obtaining in this way the load reduction and the growth of the service autonomy even if at reduced conditions.

In case the level of batteries 13 is exceedingly low because of a discharge due to a long interruption of mains or failure of the batteries themselves, all the amplifiers 31–34 will be deactivated in order to avoid their total discharge but the control circuit is anyway kept powered to be able to send to the management system the diffusion point alarm status.

The measurement board 30 receives from CPU board 27 an amplifier polling command and provides to select the contact of the relay associated to the output of the amplifier under measurement; the switch contacts of the relay provide to send back towards the measurement board the signal at 20 kHz present at the output. Through the measure of this signal, the board is able to verify the status of the amplifier (out of order or working) and of the load represented by the horns (load connected or open) and communicate it to the alarm board.

Figure 3:
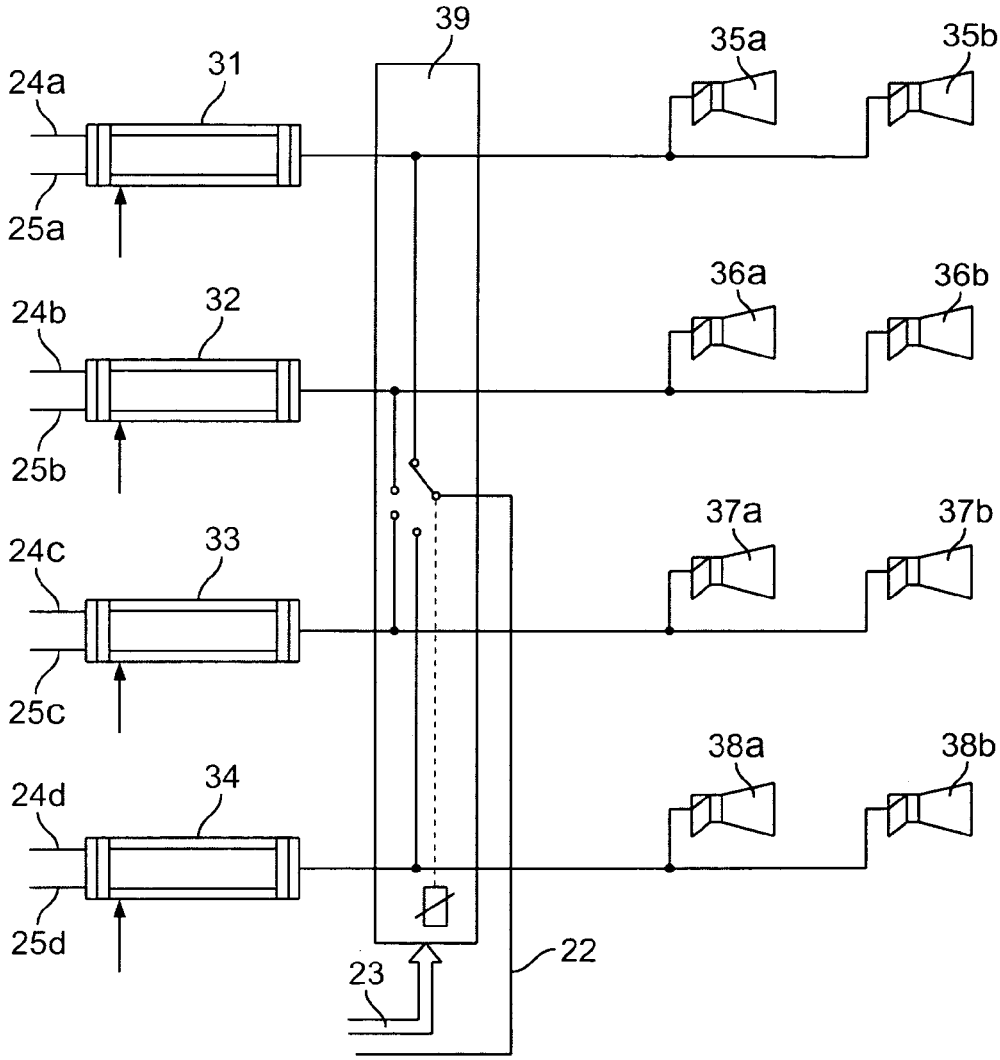
FIG. 3 shows a block diagram of the amplifiers and the diffusers of a diffusion point of the diffusion system according to the present invention.

In FIG. 3 a block diagram of the amplifiers 31–34 and the diffusers 35*a*–38*a* and 35*b*–38*b* of a diffusion point of the diffusion system according to the present invention is shown, wherein the signals coming from the block diagram of FIG. 2 are evident. In particular, measurement signal 22, control signal 23 of the test relay 39, test signal 25*a*–25*d* and vocal and alarm signals 24*a*–24*d* are evident. Relay 39 cyclically connects via control signal 23 measurement signal terminal 22 to each output of the amplifiers 31–34. In FIG. 3 only one relay 39 is schematically represented, but it is possible to use one relay for each output of amplifiers 31–34, controlled by suitable signals 23.

Figure 4:
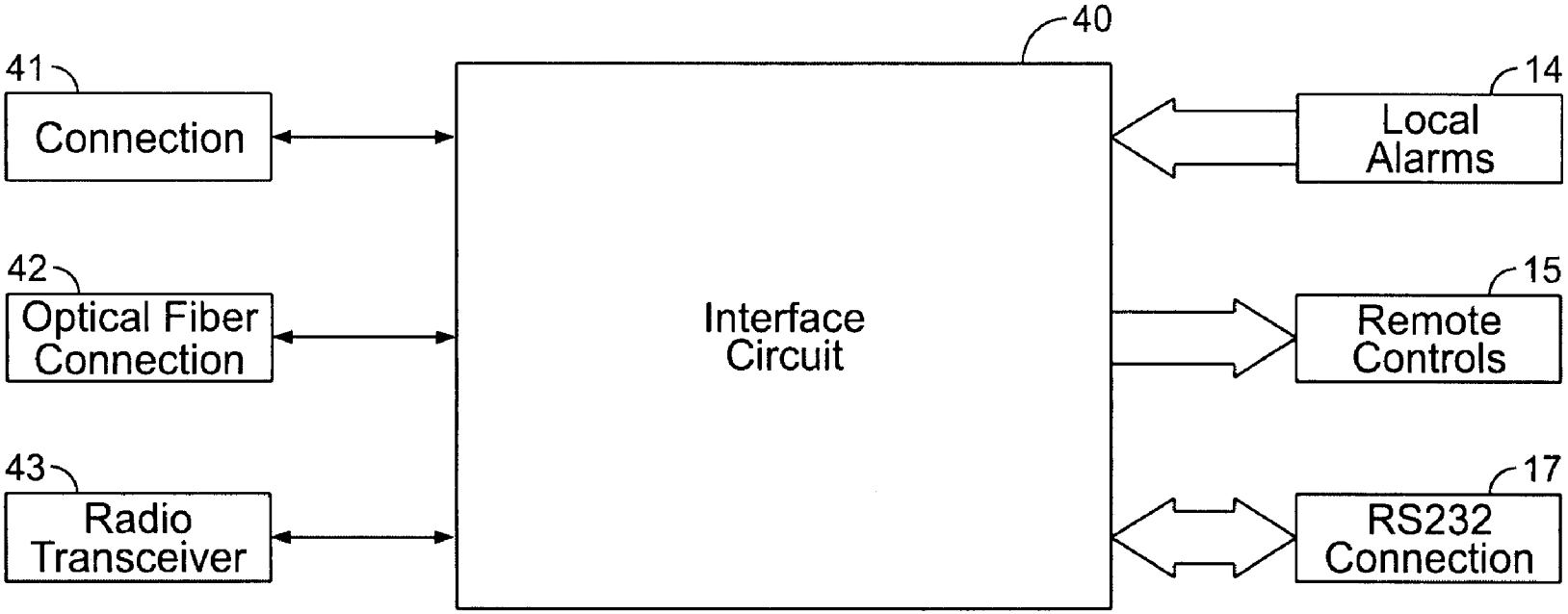
FIG. 4 shows a block diagram of an interface circuit that allows the connection between a diffusion point to a remote management system according to the present invention.

In FIG. 4 a block diagram of an interface circuit 40 is shown, that allows the connection of the control circuit 10 of a diffusion point to a remote management system. It has a series of connection signals with the analogous ones of FIG. 2 such as remote controls 15, local alarms 14 and RS232 connection 17. Additionally, it has, as a connection with the outside world, in alternative or in combination for more security, a connection 41 with a two-wire telephone cable, an optical fibre connection 42 and a link to a radio transceiver 43. Interface 40 allows the communication of the diffusion point with a remote management system that receives local alarms 14 in such a way that it knows the operating state of the diffusion system and, besides, can send, through remote controls 15, the activation signals of diffusion point 1.

The remote management system, made in this case, preferably of a computer, is connected, on request, through the selected connection method (telephone cable plus modem, optical fibre or radio link) to each diffusion point located in the control area and controls its status. The remote management system operator, according to the control results, can therefore arrange eventual repairs; additionally, he can remotely activate the alarm signals or send a vocal signal or modify the characteristic parameters of the alarm signals.

In the example described, reference is made to the sound diffusion of alarm signals for an airport or barracks area; therefore, in this case, the alarm signals are more than one and in particular they are:

- general alarm: for example continuous sound that lasts 3 minutes,
- air alarm: for example modulated sound that lasts 1 minute,
- N.B.C. alarm: for example sound that lasts 12 sec., followed by a silence interval of 12 sec., the whole lasting 3 minutes.

These alarm signals can be locally activated through dedicated buttons located on the rack frontal panel or remotely.

Through a priority switch located on the rack frontal panel it is possible to give priority to the local controls or the remote controls.

All the parameters that make the alarm signal (frequency, duration, interval and levels) can be adjusted via software during the setting up through RS232 connection 17.

Measurement board 30 cyclically, for example every 30 minutes, controls (polls) the correct operation of amplifiers 31–34 and of the load formed by horns 35*a*–38*a* and 35*b*–38*b*; test signal 25*a*–25*d* at 20 kHz is fed to one of the inputs of amplifiers 31–34 and it is cyclically read (through measurement signal 22) on the corresponding output connected to its horns group through relay control signal 23.

In this way the system is always able to recognise the status of the diffusion point, the possible damage of an amplifier or the interruption of the horns.

The type of amplifier used in the example is LBB1348/40 manufactured by PHILIPS with an output power of 400 W and a voltage of 100 V.

The amplifiers has two balanced audio inputs: a "call" input used for alarm tones with fixed signal level and a "music" input with adjustable level used for the audio signal. The switch between these two inputs is controlled by control circuit 10 through a suitable signal not shown in the figure.

The programming of the parameters relevant to the alarm types to be recorded, during the setting up of the system and in any other update situation, is made according to the following steps.

Load on the computer the application package, connect the computer serial port to RS232 connection 17 and run the application.

Verify on the status bar that the signal SERIAL CONNECTION be green, that the polling signalling be intermittent (operating connection) and that there are no red alarm signals (local alarms 14).

General Alarm Setting

Click with the mouse on RESET button to visualise the current recorded values. If it is necessary, modify with the mouse the cursor position on the frequency scale; move the mouse on the data field DURATION and input the new value of continuous sound interval in seconds. Record the new values by clicking with the mouse on RECORD button.

N.B.C. Alarm Setting

Click with the mouse on RESET button to visualise the current recorded values. If it is necessary modify with the mouse the cursor position on the frequency scale; move the mouse on the data fields DURATION, SOUND and PAUSE and input the new values, respectively in seconds for the whole alarm interval, sound interval and silence interval. Record the new values by clicking with the mouse on RECORD button.

Aerial Alarm Setting

Click with the mouse on RESET button to visualise the current recorded values. If it is necessary modify with the mouse the cursors position on the modulated sound start and end frequency scale; move the mouse on the data fields DURATION, RISE and FALL and input respectively the new values in seconds for the whole alarm duration, modulated sound rising time and falling time. Record the new values by clicking with the mouse on RECORD button.

Generator Level Setting

Click with the mouse on RESET button to visualise the current recorded values. If it is necessary modify with the mouse the cursors position on the levels scale. For LOCAL level, push the GENERAL ALARM button on the frontal panel to have a continuous sound and adjust with the mouse the cursor position to have on the amplifiers voltmeter the indication of +3 dB. For the REMORE level, activate remotely the control for GENERAL ALARM to have a continuous sound and adjust with the mouse the cursor position to have on the amplifiers voltmeter the indication of +3 dB. Record the new values by clicking with the mouse on RECORD button.

The programming of the initial settings that will be useful during the diffusion system operation to diagnose the malfunctioning of the amplifiers or the horns is made according to the following steps.

Load on the computer the application package, connect the computer serial port to RS232 connection 17 and run the application. Click on Diagnose menu on Menu bar.

Verify on the status bar that the signal SERIAL CONNECTION be green, that the polling signals be intermittent (operating connection) and that there are no red alarm signals.

Adjustment Level 3—Diffusers Not Connected

Open each amplifier load, by disconnecting the relevant cable on the rack terminal box. Click with the mouse on button TEST AMPL 1 and verify that the level be 2.5 V. If the level is different, adjust with the mouse the cursor on the level scale to have a reading equal to 2.5V. Click with the mouse on button INSERT LEVEL 3, the value beside the button will assume value 2.5V. Click with the mouse on button RECORD to record the value. Repeat the sequence for all the other amplifiers. At the end of the amplifier tests click with the mouse on button TEST END.

Adjustment Level 1—Diffusers Connected

Connect each amplifier load, by fixing the relevant cable on the rack terminal box. Click with the mouse on button TEST AMPL 1. Click with the mouse on button INSERT LEVEL 1, the value beside the button will assume the read value. Click with the mouse on button RECORD to record the value. Repeat the sequence for all the other amplifiers. At the end of the amplifier tests click with the mouse on button TEST END.

Adjustment Level 2—Partially Connected Diffusers

LEVEL 2 is a fixed reference value of intermediate between the two extreme values for the detection of partially connected diffusers. This value cannot be adjusted.

Adjustment of the Interval Time for the Automatic Test (For the Control of Horns and Amplifiers)

Input in the data field AUTOMATIC MEASURE FIELD the value in minutes of the pause time between an automatic test and the following one (nominally 30 minutes). Click with the mouse on RECORD button, in the automatic test field, to record the value. Click on AUTOMATIC TEST button to start the operation; on the data field the test signal measured values at 20 kHz of the four amplifiers appear. Exit from diagnose menu and go back to the initial window by clicking with the mouse on CLOSE button. To exit the program, select with the mouse EXIT menu.

What is claimed is:

1. Audio signal sound diffusion system, comprising:

at least one diffuser;

at least one amplifier connected to said at least one diffuser;

a generation circuit connected to said at least one amplifier for generating at least one audio signal;

a control circuit for controlling said sound diffusion system adapted to detect the malfunctions of said diffusion system and to generate an appropriate status alarm of said diffusion system in response thereto; and connection means adapted to connect said control circuit to a management system;

said control circuit being adapted to send to said management system at least one status alarm of said sound diffusion system, said status alarm signal indicating which of a plurality of malfunctions has occurred.

2. The sound diffusion system of claim 1, wherein said audio signal is an alarm signal.

3. The sound diffusion system of claim 2, wherein a local control for the manual activation of said at least one alarm signal.

4. The sound diffusion system of claim 1, wherein said at least one status alarm indicates a malfuncton selected from the list of: lack of mains voltage, failure of said at least one amplifier, failure of said at least one diffuser, and a charge state of reserve batteries for powering said diffusion system in the event of lack of mains voltage.

5. The sound diffusion system of claim 1, wherein said control circuit comprises a test circuit adapted to cyclically check the correct operation of said at least one amplifier.

6. The sound diffusion system of claim 1, wherein said control circuit comprises a test circuit adapted to cyclically check the correct operation of said at least one diffuser.

7. The sound diffusion system of claim 5, wherein said test circuit sends a test signal to the input of said at least one amplifier and measures the relevant signal at the output of said at least one amplifier.

8. The sound diffusion system of claim 2, wherein said management system is a computer.

9. The sound diffusion system of claim 8, wherein said computer allows the programming of the parameters of said at least one alarm signal.

10. The sound diffusion system of claim 1, wherein said management system is remote and is connected to said control circuit through cable.

11. The sound diffusion system of claim 1, wherein said management system is remote and connected to said control circuit through telephone line or optical fibre or radio link.

12. The sound diffusion system of claim 2, wherein said management system is adapted to send to said sound diffusion system an activation command of said at least one alarm signal.

13. The sound system of claim 6, wherein said test circuit sends a test signal to the input of said at least one amplifier and measures the relevant signal at the output of said at least one amplifier.

* * * * *